United States Patent [19]

Ewing et al.

[11] Patent Number: 4,761,709

[45] **Date of Patent: * Aug. 2, 1988**

[54] CONTACT BRUSH CHARGING

[75] Inventors: Joan R. Ewing, Fairport; Joseph A. Swift, Ontario, both of N.Y.

[73] Assignee: Xerox Corporation, Stamford, Conn.

[ * ] Notice: The portion of the term of this patent subsequent to Nov. 12, 2002 has been disclaimed.

[21] Appl. No.: 928,600

[22] Filed: Nov. 10, 1986

Related U.S. Application Data

[63] Continuation of Ser. No. 665,822, Oct. 29, 1984, abandoned.

[51] Int. Cl.[4] ..... G03G 15/02

[52] U.S. Cl. ..... 361/225; 355/3 CH

[58] Field of Search ..... 355/3 CH, 14 CH; 430/902; 361/221, 225

[56] References Cited

U.S. PATENT DOCUMENTS

| | | | |
|---|---|---|---|
| 2,774,921 | 12/1956 | Walkup | 317/262 |
| 2,987,660 | 6/1961 | Walkup | 317/262 |
| 3,235,323 | 2/1966 | Peters | 423/447.5 |
| 3,484,183 | 12/1969 | Dickson et al. | 8/116 |
| 3,691,993 | 9/1972 | Krause et al. | 118/637 |
| 3,757,164 | 9/1973 | Binkowski | 317/2 R |
| 3,841,892 | 10/1974 | Krause et al. | 117/17.5 |
| 3,877,417 | 4/1975 | Jeromin | 118/637 |
| 3,904,929 | 9/1975 | Kanaya et al. | 317/2 R |
| 4,031,188 | 6/1977 | Kohler | 423/447.6 |
| 4,086,650 | 4/1978 | Davis et al. | 361/229 |
| 4,265,990 | 5/1981 | Stolka et al. | 430/59 |
| 4,307,432 | 12/1981 | Nishikawa | 361/221 |
| 4,330,349 | 4/1982 | Swift et al. | 156/72 |
| 4,336,565 | 6/1982 | Murray et al. | 361/225 |
| 4,352,143 | 9/1982 | Uno | 361/221 |
| 4,371,252 | 2/1983 | Uchida et al. | 355/3 CH |
| 4,385,043 | 5/1983 | Cagliostro et al. | 423/447.6 |
| 4,455,078 | 6/1984 | Mukai et al. | 355/3 CH |
| 4,553,191 | 11/1985 | Franks, Jr. et al. | 361/212 |

FOREIGN PATENT DOCUMENTS

| | | | |
|---|---|---|---|
| 0055984 | 7/1982 | European Pat. Off. | 355/3 CH |
| 0089224 | 9/1983 | European Pat. Off. . | |
| 1173406 | 2/1959 | France . | |
| 57-64754 | 4/1982 | Japan | 355/3 CH |

OTHER PUBLICATIONS

Abstract of Japanese Published Application Nos. 53-102630 and 53-102631.

Surface Analyses of Carbon Fibers Produced from Polyacrylonitrile Fibers at Low Carbonization Temperatures D. E. Cagliostro, Ames Research Center, NASA, Moffett Field, California, 94035, USA (Textile Research Journal) pp. 419-427.

Electrical Resistance of Carbon Fibers—D. B. Fischback et al.—Department of Mining, Metallurgical & Ceramic Engineering—FB-10 University of Washington, Seattle, Washington, pp. 191-192.

Experimental Observations on Carbon Fiber Piezoresistance Behavior, D. B. Fischbach et al, Department of Mining, Metallurgical & Ceramic Engineering—FB-10 University of Washington, Seattle, Washington, pp. 193-194.

The oxidation of Carbon Fibers in Air Between 230° & 375° C.—Bernard H. Eckstein, Union Carbide Corp., Carbon Products Division, Parma Technical Center, Cleveland, Ohio, pp. 139-156.

Carbon Fiber Production at Low Temperatures from Polyacrylonitrile—D. E. Cagliostro, Textile Research Journal, Oct. 1980, pp. 632-638.

(List continued on next page.)

*Primary Examiner*—Arthur T. Grimley
*Assistant Examiner*—J. Pendegrass

[57] ABSTRACT

A contact brush charging device together with a method for charging an insulating layer are provided wherein the charging brush comprises a plurality of resiliently, flexible thin fibers having an electrical resistivity of from about $10^2$ ohms-cm to about $10^6$ ohms-cm and being substantially resistivity stable to changes in relative humidity and temperature. In a preferred embodiment the plurality of fibers are arranged in a uniform distribution of fibers along the length of the brush and comprise partially carbonized polyacrylonitrile fibers having an electrical resistivity from about $10^3$ ohms-cm to about $10^5$ ohms-cm and being substantially homogeneous in composition.

20 Claims, 3 Drawing Sheets

U.S. PATENT DOCUMENTS

Description of the Carbonization Process of Polyacrylonitrile in Terms of Electrical Characteristics; L. Brehmer et al., Plaste und Kautschuk, vol. 27, No. 6, pp. 309-313—1980.

Abst. of Japan, vol. 6, No. 121 (p. 126) [999], Jul. 6, 1982 & JP-A-57 46265 (Canon) 16-03—1982.

Abs. of Japan, vol. 7, No. 121 (p-199) [266], May 25, 1983 & JP-A-58 40566 (Kinoshita Kenkyousho) 09-0-3-1983.

D.C. RESISTIVITY DEPENDENCE UPON PROCESS TEMPERATURE

CONTACT BRUSH CHARGING

This is a continuation of application Ser. No. 665,822, filed Oct. 29, 1984, now abandoned.

BACKGROUND OF THE INVENTION

The present invention relates generally to charging devices and charging insulating layers. In particular, the present invention is directed to a contact charging brush and method of charging an insulating layer with said brush.

The present invention is directed to contact brush charging, brush apparatus and method of use wherein the individual fibers, upon contacting the insulating surface to be charged, do not electrically short out or otherwise destructively interfer with the electrical properties of the insulating layer as a result of certain imperfections in the layer.

In an electrostatographic reproducing apparatus commonly used today, a photoconductive insulating member may be charged to a negative potential, thereafter exposed to a light image of an original document to be reproduced. The exposure discharges the photoconductive insulating surface in exposed or background areas and creates an electrostatic latent image on the member which corresponds to the image areas contained within the original document. Subsequently, the electrostaic latent image on the photoconductive insulating surface is made visible by developing the image with a developing powder referred to in the art as toner. During development the toner particles are attracted from the carrier particles by the charge pattern of the image areas on the photoconductive insulating area to form a powder image on the photoconductive area. This image may be subsequently transferred to a support surface such as copy paper to which it may be permanently affixed by heating or by the application of pressure. Following transfer of the toner image to the support surface the photoconductive insulating surface may be discharged and cleaned of residual toner to prepare for the next imaging cycle.

In such electrostatographic apparatus in use today various types of charging devices have been used to charge the photoconductive insulating layer. In commercial use, for example, are various types of corona generating devices to which a high voltage 5,000 to 8,000 volts may be applied to the corotron device thereby producing a corona spray which imparts electrostatic charge to the surface of the photoreceptor. In addition, the corona spray generates ozone and other species which have to be collected or neutralized. Alternatively, the photoconductive insulating layer may be charged with a brush charging device which is brought into contact with the photoconductive insulating layer and to which a potential of the order of 1,200 volts is applied during the charging process. This provides a constant voltage charging process wherein, for example, if a thousand volts is applied to the brush the insulating layer maybe charged to 800 volts. This is in contrast to the corona generating devices which are based on a constant current process and therefore have large fluctation in the potential eventually developed on a conductive insulating layer. In brush charging there is a dramatic reduction in ozone generation compared to corona charging despite the fact that there may be a small amount of corona. Brush charging is 100% efficient in terms of the current going to the photoreceptor whereas corotron charging is only about 10% efficient in terms of the current going to the photoreceptor. Generally, contact brush charging has the advantage of being relatively insensitive to process speed or photoconductive insulating layer electrical history within normal operating range. In other words, in contact brush charging devices if in one cycle the photoreceptor is charged and subsequently discharged by exposure to the light and shadow pattern to provide varying potential levels, upon subsequent charging with a contact brush charging for making subsequent copies the photoreceptor will be recharged only to the initial uniform potential.

While contact brush charging provides these advantages, it also suffers from serious deficiencies in that the individual brush fibers are typically made from electrically conductive materials which may upon contact with imperfect areas of the insulating surface result in shorting of portions of the insulating surface giving rise to deletions in the output copy. In the commercial manufacture of photoreceptors (photoconductive insulating layers) it is very difficult to produce a whole layer whether it be a drum or belt wherein the dielectric strength of the layer is precisely uniform throughout the entire layer. It often happens as a result of a manufacturing defect, or contamination, or other matters that are not fully understood, that certain imperfections exist in these photoreceptors. In particular, they may have areas of relatively low dielectric strength which may be visible or invisible to the unaided eye. These defects usually are within the photoreceptor layer and randomly distributed throughout the layer. When such photoreceptors are used in commercial embodiments with contact charging apparatus employing conductive fibers the fibers contact the photoreceptor and in those areas of imperfection in the photoreceptor a path where high current densities can flow produces electrical shorting to the conductive backing on the photoreceptor layer. This shorting can produce localized heating, melting, and oxidation of the polymeric materials followed by out gassing of vaporized polymeric causing devastating irreversible damage. The result is a mechanical flaw in the photoreceptor which is either a crater or a hole in the photoreceptor layer. While initially this flaw may have been an invisible defect, it now becomes visible appearing as a hole of 1 to 2 mm in the photoreceptor surface. This "pinhole" shows up as a copy quality defect since it can act as a mechanical toner trap during the development cycle and can develop out as a black spot. It can also appear as an undeveloped area, as a result of this particular small portion no longer behaving as a photoconductive insulating layer.

Photoreceptors exhibiting this "pinhole" effect can be in a variety of different configurations including plates, drums, flexible belts and the like. Typical photoreceptors include one or more photoconductive layers on a supporting substrate. The supporting substrate may be conductive or it may be coated with a conductive layer over which photoconductive layers may be coated. Alternatively, the multilayered electrophotoconductive imaging photoreceptor may comprise at least two electrically operative layers, a photogenerating or charge generating layer and a charge transport layer which are typically applied to the conductive layer. For further details of such a layer, attention is directed to U.S. Pat. No. 4,265,990 the disclosure of which is hereby herein incorporated by reference in its entirety. In all these varying structures several of the layers may be applied through vacuum deposition techniques for very thin layers. During the several fabrication processes one or more of the layers may be exposed to contamination by foreign matter (dust) or experience other process deviations. Small imperfections give rise to "pinhole" effects with which the present invention is concerned.

PRIOR ART

Typical of devices wherein conductive, thin carbon fibers may be used in a brush form as a charging or transfer device are those described in Japanese Patent Application Nos. 53-102630 and 53-102631. Both these applications disclose conductive materials such as carbon fibers or stainless steel fibers having a resistivity somewhere in the range from $10^{-5}$ to $10^{-3}$ ohms-cm.

U.S. Pat. No. 2,774,921 to Walkup describes a brush charging apparatus for electrostatically charging an insulating imaging surface for electrophotography. Walkup recognized that if a highly conductive fiber were to come in contact with a hole or weak spot in the insulating surface it would act to short circuit the current and that it would be particularly objectionable in the case of printing plates for electrical printing. In addition to recognizing that the pliable element should not be too electrically conductive, he also recognized that it must not be too resistant to electric current flow and described materials having surface resistances in the range of 10,000 ohms to 100,000 megaohms. Walkup excluded materials such as copper, silver, and other common metals. Example he discloses at column 3, lines 22–28 include paper, cloth, certain vegetable fibers, glass cloth which had been rendered slightly conductive by metalizing or coating with hygroscopic salts such as glycerin or various salts.

We have now found that the materials suggested by Walkup are deficient in that they are all moisture sensitive materials having electrical resistivities that vary with relative humidity and temperature over time. Thus, while any one of the materials described as suitable by Walkup may be adequate at a particular point in time under certain conditions, over continued use the material being sensitive to the presence of moisture causes unpredictability in its operation. In other words, with increased water content a reduction in the resistivity would take place to the point where the fiber would once again act as conductor and electrically short the photoreceptor. We have also found that if the electrical resistivity of the individual fibers is maintained within relatively narrowed limits, that both the "pinhole" effect referred to above may be avoided and at the same time adequate current provided to the photoconductor insulating layer for necessary charging.

U.S. Pat. No. 4,336,565 Murray et al—describes a brush charging apparatus wherein the brush is comprised of electrically conductive carbon fiber filaments to which a potential may be applied and which may be used to contact charge an electrically insulating surfaces.

SUMMARY OF THE INVENTION

In accordance with the present invention a novel contact brush charging device together with a method for charging an insulating surface is provided. In particular, the brush charging device comprises a plurality of resiliently, flexible, thin fibers arranged in a brush like configuration with the fibers being held by a support means so that the distal ends of the fibers may contact the insulating layer. Further the fibers have an electrical resistivity of from about $10^2$ ohms-cm to about $10^6$ ohms-cm and are substantially resistivity stable to changes in relative humidity and temperature.

In a specific aspect of the present invention, the fibers are partially carbonized polyacrylonitrile fibers which are uniformly distributed along the length of the brush and have an electrical resistivity of from about $10^3$ ohms-cm to about $10^5$ ohms-cm.

In a further aspect of the present invention, the fibers are substantially homogeneous in composition, are generally circular in cross section and from about 8 to 10 microns in diameter.

In a further aspect of the present invention, the fibers are arranged in the brush to have a fiber fill density of from about $5\times10^4$ to $4\times10^6$ fibers per square inch.

Accordingly, it is an object of the present invention to provide an improved contact brush charging device as well as an improved method for charging insulating layers.

It is a further object of the present invention to provide a device and method for contact charging an insulating layer which does not exhibit a pin hole defect in the insulating layer by electrically short circuiting imperfections in the layer.

It is a further object of the present invention to provide a charging device and method wherein the resistivity characteristics of the charging device are substantially stable to changes in relative humidity and temperature.

It is a further object of the present invention to provide a contact charging device which is soft, being nondestructive to the insulating layer in the mechanical sense.

It is a further object of the present invention to provide a charging device and method wherein the individual fibers would not adversely effect charging performance of the brush as a whole.

It is a further object of the present invention to provide a contact brush charging device wherein the individual fibers themselves are self limiting in terms of current flow.

For a better understanding of the invention as well as other aspects and further features thereof reference is made to the following drawings and description.

DESCRIPTION OF THE PREFERRED EMBODIMENT

The invention will now be described with reference to a preferred embodiment.

Figure 1:
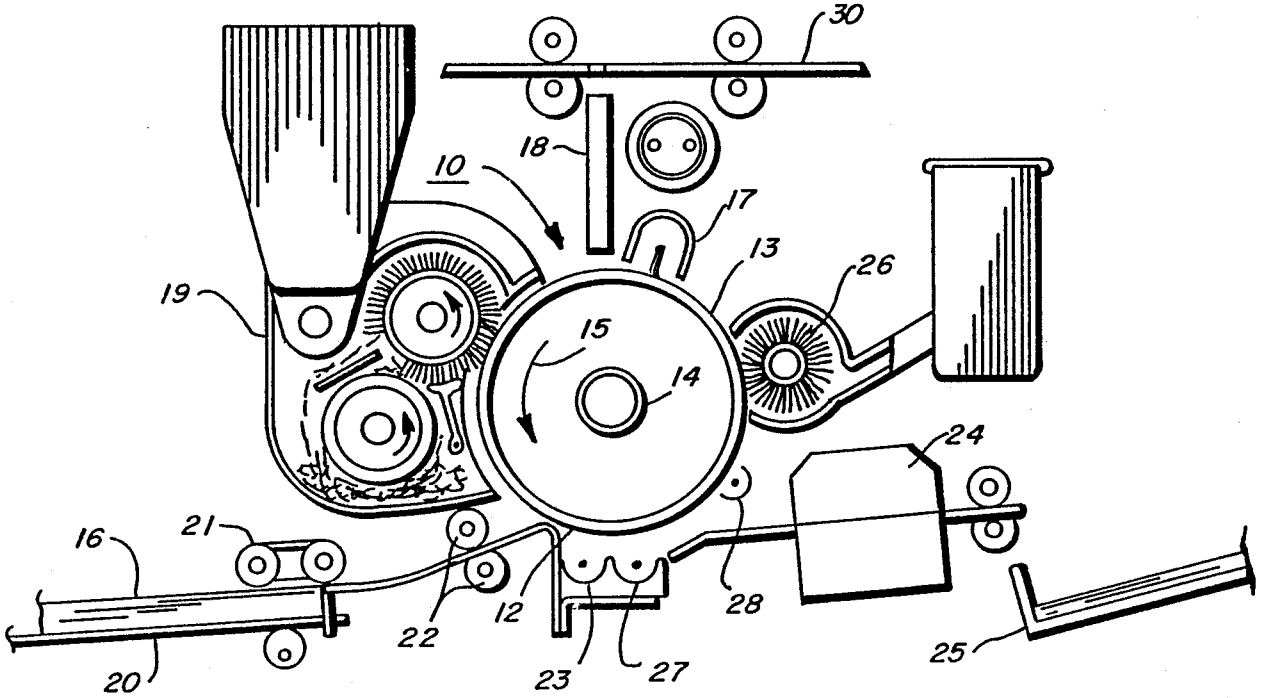
FIG. 1 is a schematic representation in cross section of an automatic electrostatographic reproducing machine with the brush charging apparatus device according to the present invention.

Referring now to FIG. 1, there is shown by way of example an automatic xerographic reproducing machine 10 which includes the corona generating device of the present invention. The reproducing machine 10 depicted in FIG. 1 illustrates the various components utilized therein for producing copies from an original document. Although the apparatus of the present invention is particularly well adapted for use in an automatic xerographic reproducing machine 10, it should become evident from the following description that it is equally well suited for use in a wide variety of processing systems including other electrostatographic systems and it is not necessarily limited in the application to the particular embodiments shown herein.

The reproducing machine 10, illustrated in FIG. 1 employs an image recording drum-like member 12, the outer periphery of which is coated with a suitable photoconductive material 13. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproduction of the original input scene information is recorded upon a sheet of final support material 16 such as paper or the like.

Initially, the drum 12 moves the photoconductive surface 13 through a charging station 17 such as contact charging brush 11 where an electrostatic charge is placed uniformly over the photoconductive surface 13 in known manner preparatory to imaging. Thereafter, the drum 12 rotates to exposure station 18 where the charged photoconductive surface 13 is exposed to a light image of the original input scene information whereby the charge is selectively dissipated in the light exposed regions to record the original input scene in the form of an electrostatic latent image. After exposure, drum 12 rotates the electrostatic latent image recorded on the photoconductive surface 13 to development station 19 wherein a conventional developer mix is applied to the photoconductive surface 13 of the drum 12 rendering the latent image visible. Typically a suitable development station could include a magnetic brush development system utilizing a magnetizable developer mix having coarse ferromagnetic carrier granules and toner colorant particles.

Sheets 16 of the final support material are supported in a stack arrangement on an elevating stack support tray 20. With the stack at its elevated position a sheet separator feed belt 21 feeds individual sheets therefrom to the registration pinch rolls 22. The sheet is then forwarded to the transfer station 23 in proper registration with the image on the drum. The developed image on the photoconductive surface 13 is brought into contact with the sheet 16 of final support material within the transfer station 23 and the toner image is transferred from the photoconductive surface 13 to the contacting side of the final support sheet 16. Following transfer of the image the final support material which may be paper, plastic, etc., as desired is transported through detack station where detack corotron 27 uniformly charges the support material to separate it from the drum 12.

After the toner image has been transferred to the sheet of final support material 16 the sheet with the image thereon is advanced to a suitable fuser 24 which coalesces the transferred powder image thereto. After the fusing process the sheet 16 is advanced to a suitable output device such as tray 25.

Although a preponderance of toner powder is transferred to the final support material 16, invariably some residual toner remains on the photoconductive surface 13 after the transfer of the toner powder image to the final support material. Following transfer of the toner image to the final support material, the residual charge remaining on the drum is reduced by the corona generated from the pre-clean corotron 28 according to the present invention. Thereafter the residual toner particles remaining on the photoconductor surface 13 after transfer of the toner image may be removed by cleaner 26.

Normally, when the copier is operated in a conventional mode, the original document to be reproduced is placed image side down upon a horizontal transparent viewing platen 30 which transports the original past an optical arrangement here illustrated as Selfoc lens 18. The speed of the moving platen and the speed of the photoconductive belt are synchronized to provide a faithful reproduction of the original document.

It is believed that the foregoing general description is sufficient for the purposes of the present application to illustrate the general operation of an automatic xerographic copier which can embody the apparatus according to the present invention.

Figure 2:
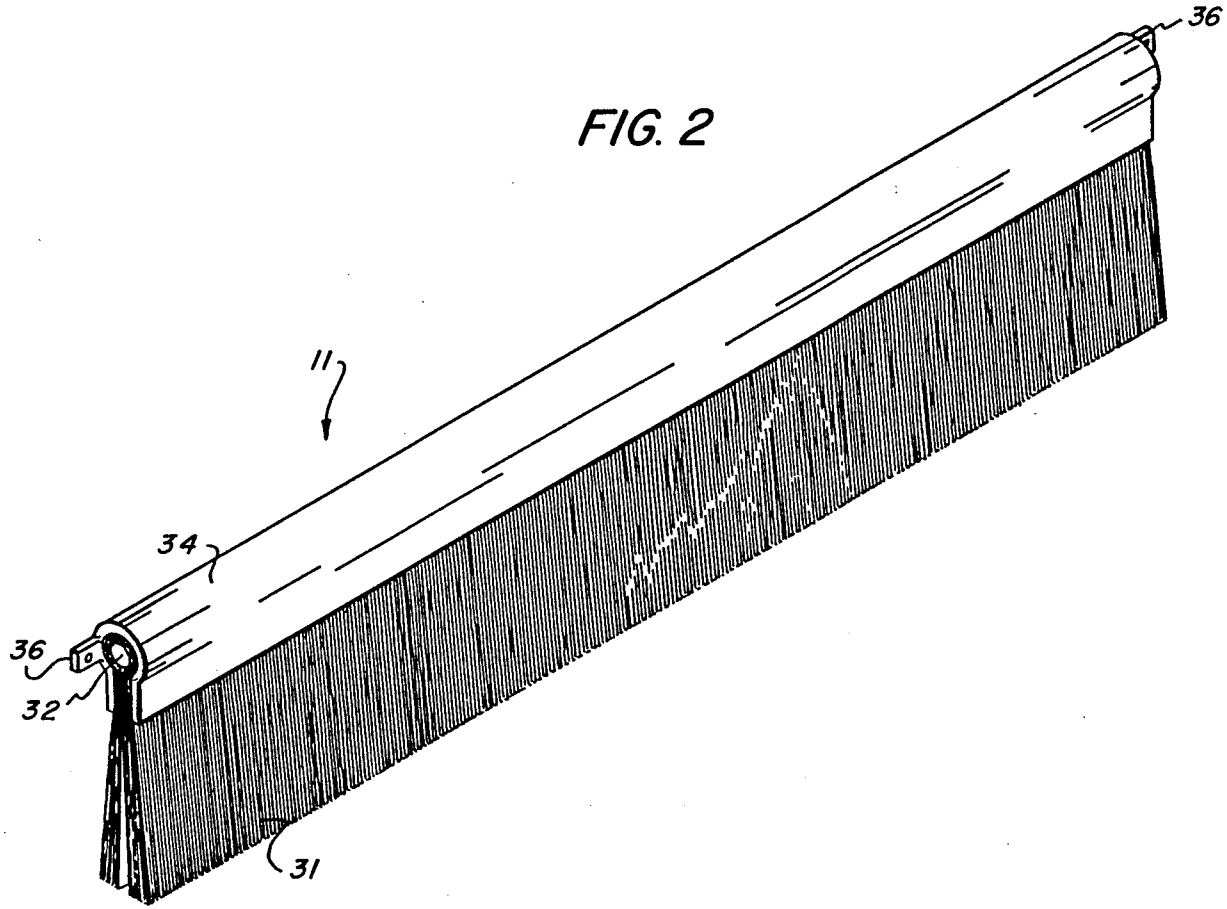
FIG. 2 is an isometric view of an embodiment of a charging brush according to the present invention.
Figure 4:
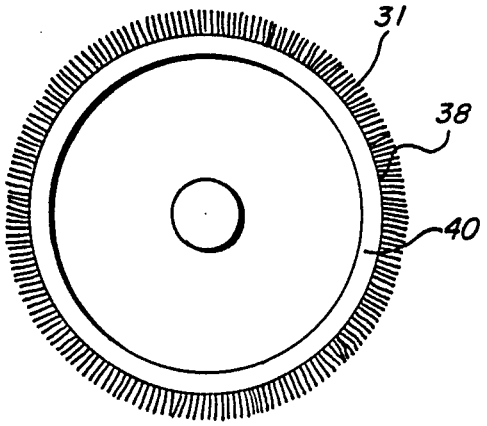
FIG. 4 is an isometric view of an alternative embodiment of a charging brush according to the present invention.

In FIG. 2 the contact brush charging device 11 is illustrated wherein a plurality of resiliently flexible thin fibers 31 are wrapped around a support rod 32. Individual fibers which are uniformly distributed along the length of the brush are retained in position on the rod by a U-shaped conductive exterior shield 34 which includes a pair of pierced tabs 36 at its ends to provide means for mounting and connecting the device to an electrical circuit. The brush may be used in a stationary position or if desired, may be oscillated in a direction transverse to the direction of movement of the photoconductive insulating layer with which it is in contact. In addition to insure charge uniformity more than one brush may be used in a parallel array of brushes. While FIG. 2 illustrates the contact charging brush to be in the form of a planar bristle brush, it will be understood that the device and process of the present invention may be used with a brush in a roller configuration as illustrated in FIG. 4. In such a configuration individual fibers 31 are mounted on or woven or knitted into a conductive resilient base 38 which is then wrapped around a conductive roller 40 connected to an electrical power supply. Such a rotary brush maximizes charge uniformity.

We have found that if contact brush charging devices are made from fibers having D.C. electrical resistivity of from about $10^2$ ohms-cm to about $10^6$ ohms-cm and are substantially resistivity stable in terms of changes in relative humidity and temperature that the pinhole effect and associated copy quality defect described above can be substantially eliminated. With fiber materials having a resistivity less than $10^2$ ohms-cm the amount of power dissipated at the point of the imperfection goes up giving rise to an increase in the pin hole effect and associated copy quality defect. With resistivities greater than $10^6$ ohms-cm and applied voltages of about 1200 volts there will be insufficient current flowing to the photoreceptor to perfect adequate charging of the photoreceptor to be used in the imaging process. We have also found that the preferred balance between electrical resistivity and conductivity within this range is in the small resistivity range of from about $10^3$ ohms-cm to about $10^5$ ohms-cm. Fibers having resistivities less than about $10^5$ ohms-cm are the most stable in terms of ongoing growth in resistivity. At this point it should be noted that all resistive fibers tend to grow slightly in resistivity with aging. Fibers having resistivities greater than $10^3$ ohm-cm have better current surge limiting capabilities and therefore are less likely to cause pinholing. While materials exhibiting the general and preferred electrical resistivities have existed in the prior art, it is noted that those materials were generally of the nature described in Walkup and not resistivity stable with respect to changes in relative humidity. In this context what we mean by substantially resistivity stable is less than order of magnitude change in resistivity based on changes in temperature and relative humidity over normal operating range and aging. Accordingly we are talking about a stability generally in the range of 60° F. to 90° F. and 10 to 80% relative humidity. In addition, many of the materials previously available such as stainless steel, brass and aluminized fiber glass do not have other desirable physical characteristics in that they were too hard or brittle, thereby causing damage to the photoreceptor when they came in contact with it. Furthermore some materials having the necessary properties have previously been made by a sophisticated manufacturing techniques such as by doping and loading with pigments all of which leads to a mechanical degradation in the mechanical properties of the materials.

Fibers of the present invention are resiliently flexible in that if they are deflected by a sheet passing their location they spring back into their original position after the trailing edge of the sheet has passed. Furthermore, if the fibers are compressed for an extended period of time they will return to their original orientation when the compression is removed. They are preferably relatively non-brittle or soft in order to reduce any possible physical deterioration of the photoreceptor. Typically the fibers have an elongation of the tensile stress of from about 1.2% to about 3% of their initial length before they fracture. In addition, the resistive fibers of the present invention are generally circular in cross section having a diameter of from about 5 microns to about 50 microns and preferably from about 8 microns to about 10 microns which provides them with a reduced tendency to fracture or break.

Figure 3:
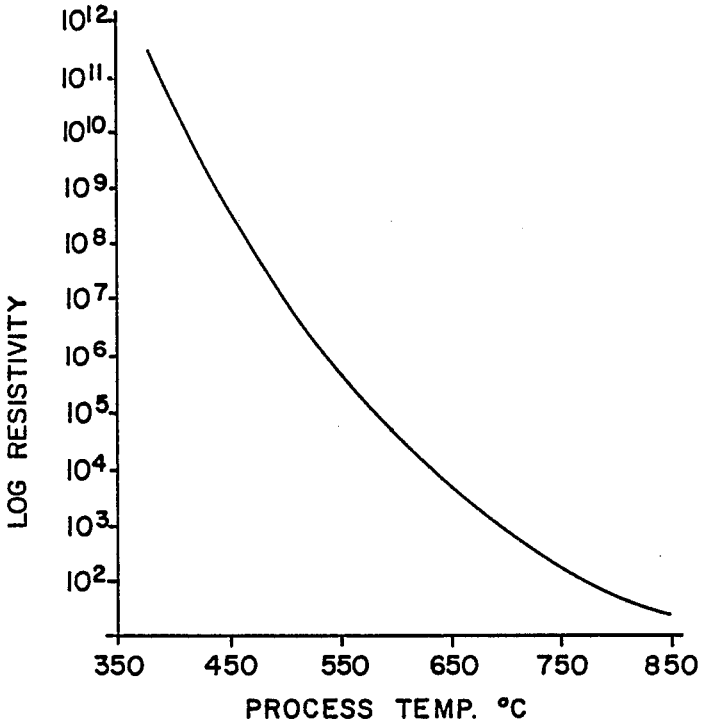
FIG. 3 is a graphical representation of the D.C. resistivity dependence upon process temperature for preferred fibers according to the present invention.

Any suitable material may be used for the individual fibers in the contact brush charging device of the present invention as long as the fibers exhibit or possess the above described properties. Typically the fibers are carbonaceous or have a carbonaceous core. A preferred fiber that may be used in a contact charging brush of the present invention are those carbon fibers that are obtained from the low heat treatment temperature processing to yield partial carbonization of the polyacrylonitrile (PAN) precursor fibers. It has been found for such fibers that by carefully controlling the temperature of carbonization within certain limits that precise electrical resistivities for the carbonized carbon fibers may be obtained. In this regard attention is directed to FIG. 3 which shows a graph of resistivity and its dependence on process temperature for the carbonization process. The polyacrylonitrile precursor fibers are commercially produced by the Stackpole Company, Celanese Corporation and others in yarn bundles of 1,000 filaments to 180,000 filaments. The yarn bundles are partially carbonized in a two stage process involving stabilizing the pan fibers at temperatures of the order of 300° C. in an oxygen atmosphere to produce preox-stabilized PAN followed by carbonization at elevated temperatures in an inert (nitrogen) atmosphere. The D.C. electrical resistivity of the resulting fibers is controlled by the selection of the temperature of carbonization. For example, as illustrated in FIG. 3 carbon fibers having an electrical resistivity of from about $10^2$ to about $10^6$ ohms-cm are obtained if the carbonization temperature is controlled in the range of from about 500° C. to 750° C. Fibers resulting from such a process are stable to changes in temperature and relative humidity in that the electrical resistivity does not change with relative humidity. This is in sharp contrast with materials described in the above referred to Walkup patent, wherein electrical resistivity could change many orders of magnitude with changes in relative humidity. Furthermore, the fibers are produced or made without the use of fillers, plasticizers, waxes or other agents that can leach out of the body of the fiber and subsequently lead to contamination of the photoreceptor. As a result the fiber produced is substantially homogenous in composition and is relatively pure in the sense that no additives including unbound species are present. Furthermore, all the nitrogen and oxygen left in the fiber are bound in some form to the carbon or each other as part of the residual polymer chain.

The stable nature of the electrical resistivity with regard to temperature and relative humidity is in contrast to most polymeric fibers wherein the conductivity is obtained by adding carbon black and other additives which are physically admixed in one form or another. In the use of such fibers it typically happens that the carbon black or other additives may end up becoming deposited on the photoreceptor.

The fibers according to the present invention are capable of being packed very tightly to provide a high fiber fill density (the number of free fiber ends per unit area). Typically the contact brush charging devices of the present invention have fiber fill densities of from about $5\times10^4$ to $4\times10^6$ fibers per square inch. These fibers lend themselves to weaving and can therefore be woven into a fabric if desired. In operation, each individual fiber acts as a charging element without mechanically eroding or otherwise defacing the photoreceptor area. Accordingly, the contact charging brush according to the present invention posesses great functional life.

The preferred carbon fibers used in the practice of the present invention are commercially available from Celanese as CELECT 675. They are made by a variety of processes which are taught generally in the literature. For further reference to the processes that may be employed in making these carbonized fibers attention is directed to the following sources in the literature. "Carbon Fiber Production at Low Temperatures from Polyacrylonitrile", D. E. Cagliostro, *Textile Research Journal,* October 1980, pages 632–638; "Description of the Carbonization Process of Polyacrylonitrile Fibers in Terms of Electrical Characteristics:, L. Brehmer et al, *Plaste und Kautschuk,* 1980, Vol. 27, No. 6, pages 309–313. "Electrical Resistance of Carbon Fibers", D. B. Fischbach et al., Department of Mining, Metallurgical and Ceramic Engineering. FB-10, University of Washington, Seattle, Wash., pages 191, 192.

FIG. 3 represents the variation in resistivity with process temperature as the log of resistivity versus process temperature. From this representation it is clear that precision control of the resistivity may be obtained by controlling the temperature of carbonization. Furthermore as pointed out preferred fibers employed in the practice of the present invention are stable in that their resistivity does not change with relative humidity or temperature, they are highly flexible, fine in diameter, exhibit substantially no compression set and an elongation of only 1.2 to 3%.

The following chart indicates contact brush charging performance for several fibers having different D.C. electrical resistivities. In each instance a brush having a fiber fill density of about 40,000 fibers per inch and the same geometric dimension was constructed. The conductive graphite and stainless steel fibers were made according to the mandrel winding technique of U.S. Pat. No. 4,330,349 Swift et al wherein a strip of double backed foam adhesive tape was placed on the mandrel, the fibers wound around the mandrel followed by alternate double backed foam adhesive tape and additional fiber windings until a brush having four fiber winding layers was obtained. Aluminum strips were then placed on the outside tapes to enclose and laminate the brush and provide electrical contact to the fibers. The ends of the brushes were trimmed to a projecting length of about one half inch with a guillotine cutter. Then the back side of the brush was coated with conductive silver paint to assure electrical contact to all fibers and seal the fibers into the brush.

The Stackpole fibers were supplied as four inch wide tows of 40,000 per inch. These tows were manually layered using strips of double backed foam tape, then aluminum stips were used to enclose the laminate and form the brush root or handle as well as the electrical contact to the fibers. The tows projected perhaps an inch or so from the aluminum and were trimmed to a projecting length of typically one half inch with a guillotine cutter.

The four inch long brushes with a free fiber length of one half inch were then individually tested by being mounted over a rotating drum bearing a photoconductive surface such as that described in U.S. Pat. No. 4,265,990 and in contact with this surface. In one revolution of the drum, the voltage applied to the brush was ramped from zero to −1500 volts, to deposit a linearly increasing charge density on the photoreceptor which was measured as the drum rotated under an electrometer. The slope of the V (photoreceptor) vs. V (applied) line is a measure of charging ability. For the brushes of the invention, this slope is very nearly unity, i.e., the photoreceptor surface potential tracks the applied voltage independent of other process variations such as speed, hence the term "constant voltage charging". When the resistivity of carbon fiber is too high, the slope of this charging curve is much less than unity so that V (photoreceptor) is increasingly less than V (applied). This means that V (applied) must increase to achieve the same result as with a more conductive brush and thereby some of the advantage of brush charging is lost. When the fibers are too conductive, pinhole damage occurs in the photoreceptor during the act of charging and the size and number of such pinholes will increase as the conductivity of the fibers increases. The performance is summarized in the following chart.

| Material | Carbonizing Temp | Resistivity Ohm/cm | Performance |
|---|---|---|---|
| "Conventional" Conductive Graphite (Hercules, Celanese and Union Carbide)) | 1200° C.–2000° C. | $10^{-3}$ | Pinholing |
| Stainless Steel (Schlegel) | — | $10^{-5}$ | Pinholing |
| Stackpole | | | |
| 1 | 382° C. | $1.5 \times 10^{11}$ | Too insulating |
| 2 | 421° C. | $1.5 \times 10^{9}$ | Too insulating |
| 3 | 493° C. | $7.4 \times 10^{7}$ | Marginal charging |
| 4 | 549° C. | $4.0 \times 10^{6}$ | Low charging |
| 5 | 610° C. | $7.4 \times 10^{4}$ | Acceptable charging |
| 6 | 654° C. | $1.8 \times 10^{3}$ | Acceptable charging |
| Panex 30 | greater than 1000° C. | 10 | Pinholing |

The conventional conductive graphite fibers referred to above are available from Hercules, Celanese and Union Carbide were Celion 6000 carbon fibers, Celanese, Chatam, N.J.; Thornel 50 and 300 (PAN) carbon fibers, Union Carbide, Chicago, Ill.; Magnamite AS4-PAN based graphite fiber Hercules, Wilmington, Del. The stainless steel fiber is available from Schlegel Corporation, Rochester, N.Y. Panex 30 is available from Stackpole Fibers Company, Lowell, Mass. Fibers 1–6 are PAN fibers made by Stackpole and carbonized at the temperature indicated made for Xerox Corporation.

As may be observed from the table the pinhole effect was observed with the conductive fibers (the conventional conductive graphite, stainless steel and Panex 30). Stackpole numbers 1, 2, 3 were too insulating to provide reliable uniform charging. Stackpole numbers 4, 5 and 6 which exhibited resistivity from $1.8 \times 10^3$ to $4.0 \times 10^6$ charged the photoreceptor with acceptable charging being obtained from Stackpole fibers numbered 5 and 6.

Thus according to the present invention the contact brush charging device together with a method for charging a photoreceptor has been provided wherein commercially produceable long life materials can be selected which are compatible with the photoreceptor surface and do not produce the "pin hole effect" referred to above. Furthermore the resistivity of the brush charging device can be controlled according to the carbonization temperature. The brushes so produced are soft being non-destructive to the photoreceptor in a mechanical sense. Furthermore any shorting out of individual fibers will not adversely effect the charging performance of the brush in that the fibers are self limited in terms of current flow since the current flow in a single fiber during shorting will go to ground on the photoreceptor without decreasing the voltage in the entire brush because of the high resistivity of each individual fiber. Furthermore the preferred fibers according to the present invention do not deposit anything on the photoreceptor in terms of wear, debris, and do not abrade the photoreceptor.

All the patents, and publications referred to herein are hereby incorporated in their entirety into the specification.

While the invention has been described in detail with specific reference to contact brush charging device for use in electrostatographic reproducing apparatus it will be understood that a brush charging device may have application in many different fields. They may, for example, be used as static eliminator brushes or biased and unbiased photoreceptor devices. Furthermore while the invention has been exemplified with specific reference to the preferred partially carbonized polyacrylonitrile fibers, it should be understood that it has application with any fibers having the specified electrical properties. It will be appreciated that various modifications may be made from the specific details described herein without departing from the spirit and scope of the invention. It is intended that any such modification as may be made by the artisan shall come within the scope of the appended claims.

What is claimed is:

1. A contact brush charging device for charging an insulating layer comprising a plurality of resiliently flexible thin partially carbonized polyacrylonitrile fibers arranged in a brush like configuration, said fibers being supported by a support means so that the distal ends of the fibers may contact the insulating layer and having an electrical resistivity of from about $10^2$ ohms-cm to about $10^6$ ohms-cm and being substantially resistivity stable to changes in relative humidity and temperature.

2. The device in claim 1, wherein said fibers have an electrical resistivity of from about $10^3$ ohms-cm to about $10^5$ ohms-cm.

3. The device of claim 1, wherein said plurality of fibers are arranged in a uniform distribution along the length of the brush.

4. The device of claim 1, wherein said fibers are substantially homogenous in composition.

5. The device of claim 1, wherein said fibers are generally circular in cross section and from about 5 microns to about 50 microns in diameter.

6. The device of claim 5, wherein said fibers are from about 8 microns to about 10 microns in diameter.

7. The device of claim 1, wherein said fibers are arranged in said brush to have a fiber fill density of from about $5\times10^4$ to $4\times10^6$ fibers per square inch.

8. The device of claim 1, wherein said fibers are arranged in a rotary brush configuration around a cylindrical conductive sleeve.

9. The method of charging an insulating layer comprising contacting the surface with a charging brush having applied thereto an electrical potential, said charging brush comprising a plurality of resiliently flexible thin partially carbonized polyacrylonitrile fibers arranged in a brush like configuration, said fibers being supported by a support means so that the distal ends of the fibers may contact the insulating layer and having an electrical resistivity of from about $10^2$ ohms-cm to about $10^6$ ohms-cm and being substantially resistivity stable to changes in relative humidity and temperature.

10. The method of claim 9, wherein said fibers have an electrical resistivity of from about $10^3$ ohms-cm to about $10^5$ ohms-cm.

11. The method of claim 10, wherein said plurality of fibers are arranged in a uniform distribution along the length of the brush.

12. The method of claim 11, wherein said fibers are substantially homogenous in composition.

13. The method of claim 9, wherein said fibers are generally circular in cross section and from about 5 microns to about 50 microns in diameter.

14. The method of claim 13, wherein said fibers are from about 8 microns to about 10 microns in diameter.

15. The method of claim 14, wherein said fibers are arranged in said brush to have a fiber fill density of from about $5\times10^4$ to $4\times10^6$ fibers per square inch.

16. The method of claim 9, wherein said fibers are arranged in the form of a rotary brush.

17. A contact brush charging device for charging an insulating layer comprising a plurality of resiliently flexible thin partially carbonized polyacrylonitrile fibers arranged in a brush like configuration, support means for supporting said fibers so that the distal ends of the fibers may contact the insulating layer, said fibers being homogenous in composition having an electrical resistivity of from about $10^2$ ohms-cm to about $10^6$ ohms-cm, substantially resistivity stable to changes in relative humidity and temperature, and self limiting in terms of current flow to thereby avoid electrically short circuiting imperfections in said insulating layer.

18. The device of claim 17, wherein said fibers are arranged in said brush to have a fiber fill density of from about $5\times10^4$ to $4\times10^6$ fibers per square inch.

19. The method of charging an insulating layer, comprising contacting the surface with a charging brush having applied thereto an electrical potential, said charging brush comprising a plurality of resiliently flexible thin partially carbonized polyacrylonitrile fibers arranged in a brush like configuration, support means for supporting said fibers so that the distal ends of the fibers may contact the insulating layer, said fibers being homogenous in composition having an electrical resistivity of from about $10^2$ ohms-cm to about $10^6$ ohms-cm, substantially resistivity stable to changes in relative humidity and temperature, and self limiting in terms of current flow to thereby avoid electrically short circuiting imperfections in said insulating layer.

20. The method of claim 19, wherein said fibers are arranged in said brush to have a fiber fill density of from about $5\times10^4$ to $4\times10^6$ fibers per square inch.

* * * * *